US005096395A

United States Patent [19]

Todescat et al.

[11] Patent Number: 5,096,395

[45] Date of Patent: Mar. 17, 1992

[54] DISCHARGE VALVE FOR RECIPROCATING HERMETIC COMPRESSOR

[75] Inventors: Marcio L. Todescat; Jose L. Driessen: Dietmar E. B. Lilie, all of Joinville, Brazil

[73] Assignee: Empresa Brasileira de Compressores S/A - Embraco, Joinville SC, Brazil

[21] Appl. No.: 609,995

[22] Filed: Nov. 7, 1990

[30] Foreign Application Priority Data

Nov. 8, 1989 [BR] Brazil ..... PI8905898

[51] Int. Cl.[5] ..... F16K 15/02

[52] U.S. Cl. ..... 417/569; 137/543.19

[58] Field of Search ..... 417/569, 571; 137/543.17, 543.19, 543.21

[56] References Cited

U.S. PATENT DOCUMENTS

| | | | |
|---|---|---|---|
| 1,737,710 | 12/1929 | Erbach | 137/543.19 |
| 1,938,418 | 12/1933 | Evans | 137/543.19 X |
| 4,612,962 | 9/1986 | Purvis | 137/543.17 X |
| 4,729,402 | 3/1988 | Blass | 137/543.19 X |

FOREIGN PATENT DOCUMENTS

| | | | |
|---|---|---|---|
| 768172 | 2/1934 | France | 417/571 |
| 859968 | 1/1941 | France | 417/571 |

*Primary Examiner*—Robert G. Nilson
*Attorney, Agent, or Firm*—Darby & Darby

[57] ABSTRACT

A discharge valve for a reciprocating hermetic compressor of the type comprising a cylinder housing a reciprocally driven piston. A valve plate is mounted on the cylinder and has a discharge orifice the outer face of the valve plate having a recess with a side wall surrounding said discharge orifice and defining a valve seat. A sealing member is axially movable between a closing position against the valve seat. A backstop member is externally attached to the valve plate so as to limit the axial displacement of the opening sealing member. Guide elements for axial displacement of the sealing member are provided around the latter and mounted between the valve plate and the backstop member. There is a resilient deformable means with an end attached to the backstop member and another end opposite to the first one, provided at a plane adjacent to the outer face of the sealing member, opposite to that face sealing against the valve seat. When the latter is at a closing position of the valve seat, such resiliently deformable means being pressed by the sealing member, from a non-pressed condition to a resiliently pressed condition when the sealing member is displaced from the closing to the opening position, by means of a predetermined pressure value in the cylinder and the resiliently deformable means being guided by the backstop member while it is deformably moved by the axial displacement of the sealing member.

13 Claims, 3 Drawing Sheets

DISCHARGE VALVE FOR RECIPROCATING HERMETIC COMPRESSOR

FIELD OF THE INVENTION

This invention relates to a hermetic compressor for small refrigerating machines and, more particularly, to a new discharge valve construction for reciprocating hermetic compressors.

BACKGROUND OF THE INVENTION

In reciprocating hermetic compressors with small displaced volume, the discharge valve directly affects compressor energy and volumetric losses.

The discharge valve energy loss is related to a process for opening the valve and to the gas discharge period. In the opening process, an overpressure loss is basically caused by the valve inertia, the adhesion between the valve blade and the valve plate due to oil presence and blade pre-tension. During the gas discharge period, losses are related to charge loss due to flow restrictions and to the power spent to maintain the valve blade spaced from the seat since said blade is prone to close because it has a spring effect.

Both the volumetric loss and the energy loss are affected as well by the gas retained in the discharge passage and the gas coming back from inside the cylinder due to the later valve closing.

As hereinabove described, it could be said that an accurate definition of constructive characteristics of the outlet valve is an important aspect for sizing the hermetic compressor. Usually valves which are available for this type of compressor are for example those described in the following documents U.S. Pat. No. 4,723,896 and Brazil PI 8400733 (DE P 3305791.5/83).

In either of the prior arrangements, a recess is used in the valve plate which extends along the region of the discharge orifice and into which the blade itself an additional reinforcement blade are inserted, the latter blade being overlapped on the first blade in order to give a spring effect upon the assembly. The valve is completed by using a backstop limiting the displacement and helping the attachment of the blade and the additional blade and/or reinforcement.

In the prior valve, the constructive form is such that from, a predetermined displacement step of the blade, there will be contact with the reinforcement blade, and the assembly will have its inertia greatly increased, this to be overcome and supported by the gas to be discharged. This characteristic additionally increases the energy needed in relation to that which is necessary to simply expel the gas from inside the cylinder. Therefore, this will reduce the energy efficiency of the compressor.

In reciprocating compressors using air as an operating fluid, mainly those with a large displaced volume, discharge valves formed of a spring overlapped upon a disc acting as a seal when seated on the orifice are used. In this case, the spring is made so as to have only one stiffness along the whole course of the disc opening.

Another type of discharge used in hermetic compressors for small refrigerating machines is described in the Brazilian Patent Application No. 8900196. In this case, the discharge valve is formed of a spring, one end of which overlappingly engaged a disc which will act as a seal when seated in the orifice and a backstop mounted on the cylinder cover and the inside of which the other spring end engaged. This backstop has also the purpose of guiding the spring and defining the maximum axial displacement separating the sealing disc from the orifice.

In this type of assembly a great number of tolerances are involved. Thus, in a given assembly said spring could be exerting a pre-tensioning on the disc thereby making it difficult to open a valve and a power loss is caused by overpressure.

In another assembly the spring could be so far from the disc so as to allow a great quantity of gas to return to the cylinder, since the disc will seat in the orifice only when a sufficient pressure differential occurs between the discharge chamber and the cylinder, thereby causing a volumetric loss.

SUMMARY OF THE INVENTION

One object of the present invention is to provide a valve for reciprocating hermetic compressors which is able to overcome those prior mentioned failures and deficiencies.

A further object of the present invention is to provide a discharge valve of the above defined type which is simple to produce and has a cost which is acceptable.

The discharge valve of the invention is applied to a reciprocating hermetic compressor of the type including a cylinder housing a reciprocally driven piston and a fixed end valve plate provided with a discharge orifice, the outer face of the valve plate being provided with a recess having a side wall According to this invention said valve comprises a sealing member axially displacable between a closing position against the valve seat and an opening position away from said valve seat. A backstop member is attached externally to the valve plate so as to limit the axial opening displacement of the sealing member. Axial displacement guide members for said sealing member are arranged around said sealing member and fixed between the valve plate and the backstop member. A resiliently deformable means having an end engaging said backstop member and another end, which is opposed to the first end, is placed in a plane adjacent to the outer face of the sealing member opposite to the inner face for sealing against the valve seat.

When the sealing member is in a position closing the valve seat, the resiliently deformable means being compressed by the sealing member, from a non-compressed condition to a resiliently compressed condition when the sealing member is displaced from the closing position to the opening position due to a gas pressure value in said cylinder. The resiliently deformable means is guided by the backstop member during the deformation movement thereof caused by axial displacement of the sealing member.

One of the advantageous aspects of the above constructive arrangement is due to the fact that the backstop member is attached to the valve plate, thereby eliminating the effects of the dimensional changes of the cylinder cover and of the sealing gasket which is placed between the cylinder cover and the valve plate.

Another advantageous aspect of the assembly as proposed by this invention is relation with that assembly wherein the housing is an integral part of the cylinder cover (Brazil Patent of Invention PI 8900196) is that the resiliently deformable member, generally a spring, is positioned concentrically in relation to the sealing disc.

Another positive aspect is due to the fact that the spring has one of its ends attached to the backstop thus allowing the spring height to be controlled. This eliminates the influence of the tolerances of the spring and the backstop member in order that the only tolerances involved are that for the assembly of the spring in the backstop member and that of the sealing disc thickness. Thus, the problems of pre-tensioning changes or clearance of the spring in relation to the sealing disc are essentially eliminated. Another beneficial effect of the invention is that the axial displacement of the backstop relative to the sealing disc has a lower number of tolerances involved causing the passage area through the diffuser to be more constant from compressor set to compressor set.

The above mentioned advantageous aspects will effectively contribute to reduce power and volumetric losses in reciprocating hermetic compressors.

BRIEF DESCRIPTION OF THE DRAWINGS

This invention will be described as follows by making reference to the attached drawings, wherein.

DETAILED DESCRIPTION OF THE INVENTION

Figure 1:
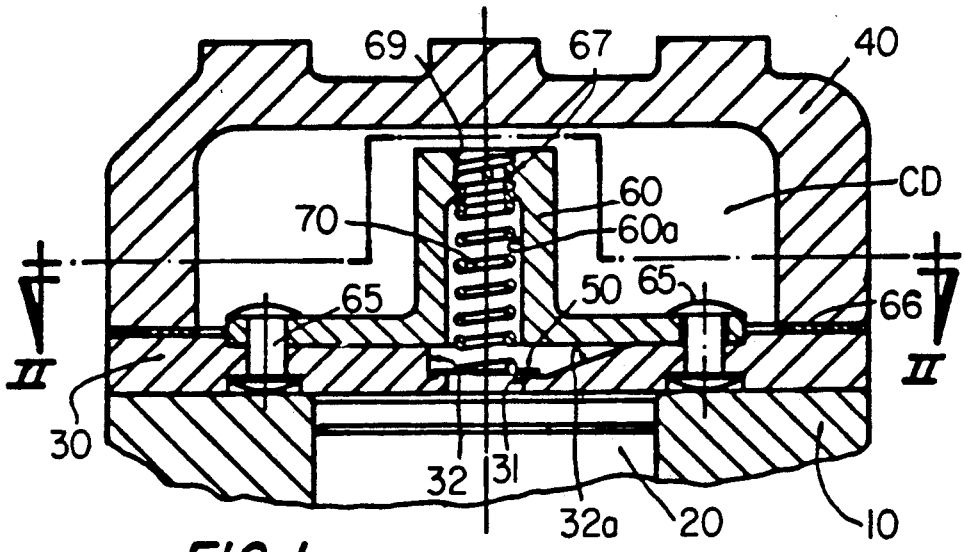
FIG. 1 is a longitudinal section view of the reciprocating hermetic compressor incorporating the discharge valve according to the invention, when in the closed position.

According to the drawings above mentioned the discharge valve is applied to a reciprocating hermetic compressor of the type including a cylinder 10 inside which a piston 20 reciprocates. A valve plate 30 is attached to the cylinder 10 end face, said valve plate having a discharge orifice 31 and being kept against cylinder 10 by means of an end cover 40 defining a discharge chamber CD and a suction chamber CS divided by a wall 41. There is a gasket 6 between the cover and the valve plate 30. The cover 40 has mounting holes 16 to accept fasteners such as screws (not shown) hold it and the valve plate to the cylinder.

Figure 3:
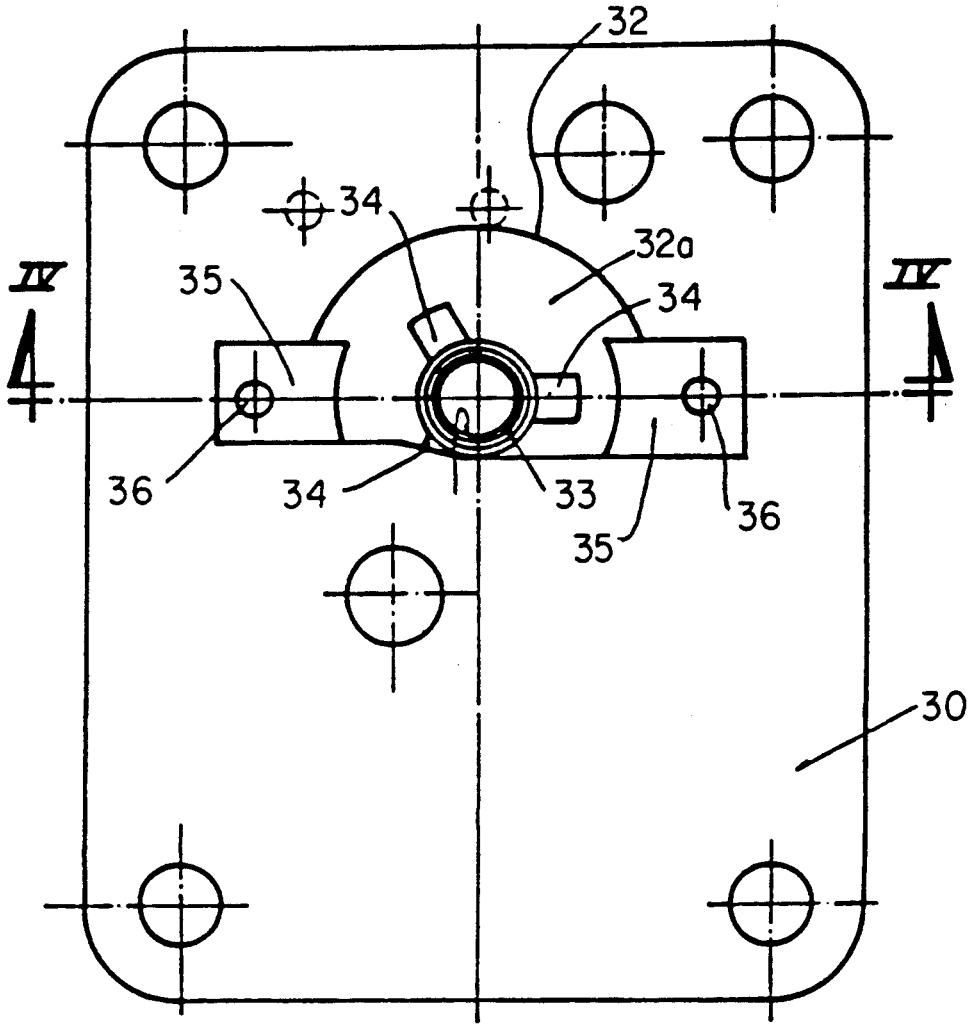
FIG. 3 is a plan view of the outer face of the valve plate of the assembly of FIG. 1.
Figure 4:
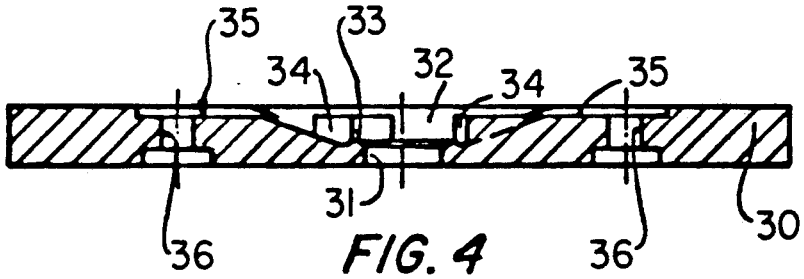
FIG. 4 is a cross section view of the valve plate taken along with line IV—IV of FIG. 3, showing the housing recess of the valve seat and the axial displacement guides of said sealing disc.

As shown in FIGS. 1, 3 and 4, the outer face of the valve plate 30 is provided with a recess 32 incorporating, in the bottom wall thereof, an annular valve seat projection 33, preferably rounded, surrounding the discharge orifice 31 and set in relation to the side wall **32*a* of the recess 32 so as to define a valve seat 33 provided at an axially set back level in relation to the plane of said outer face of said valve plate 30**.

According to a preferred shape, the side wall **32*a* of the recess 32 is sloped (see FIG. 4**) so as to define at least a portion of a diverging tapered surface thereby facilitating the gas flow as will hereinafter be described.

Said side wall **32*a* of the recess 32 incorporates a plurality of radially arranged and equally spaced projections 34 which extend axially from said side wall 32*a* until they have an end face thereof provided at a plane intermediate to the outer face plane of the valve plate 30 and the plane of the valve seat 33. The axial clearance between the intermediate plane of the projections 34 and the valve seat plane 33 is at least equal to the maximum axial displacement course of a flat sealing disc 50 defining the sealing member to be seated on the valve seat 33 and having a diameter slightly larger than the diameter of said valve seat 33**.

The radially extending inner faces of the projections 34 are shaped to define arcuate portions having a circumference with a diameter larger than the sealing disc 50, so as to function as lateral guides for the sealing disc 50 while axially alternately displacing to open and close the valve seat 33.

The valve further includes a backstop member 60 which, in the illustrated embodiment, is shaped like an oblong body, axially provided inside the discharge member CD. Backstop 60 is internally provided with a longitudinal chamber **60*a* which is open at the end of the body 60 adjacent to the valve plate 30 and incorporating radial flanges 61, preferentially two in number, being opposite and coplanar with a rectangular shape. The backstop flanges 61 are partially fitted in recess 35 located in the outer face of said valve plate 30. The bottom faces of the flanges 61 are located in a plane generally coinciding with the intermediate plane of the end face of projections 34. The attachment of the radial flanges 61 to the valve plate 30 can be made by rivets 65, the heads of which faces the inner face of the valve plate 30 being set back in relation to said inner face. The rivets are placed through holes 66 and 36 in the flanges 61 of the backstop member 60 and valve plate 30**, respectively.

Inside the backstop member 60, a helical spring 70 is housed with one end attached to the end of the backstop member 60. The other end of spring 70 is seated against the outer face of the sealing disc 50, the spring 70 having the center axis thereof coinciding with the center axis of the sealing disc 50.

Figure 5:
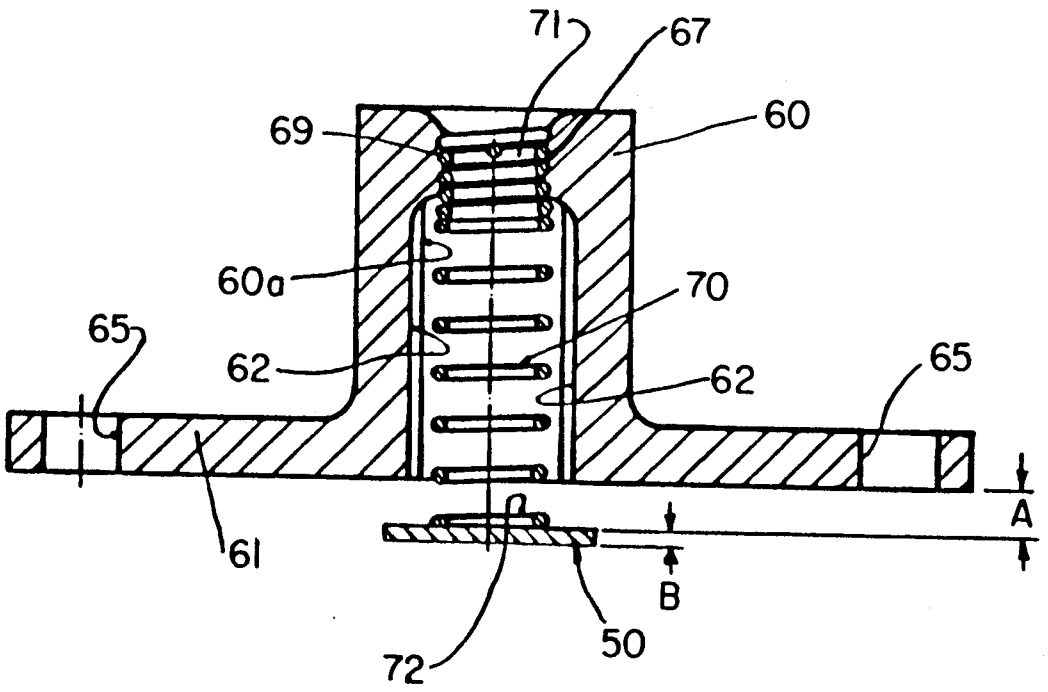
FIG. 5 is a magnified longitudinal view of the sealing disc-spring-backstop member assembly.

In the illustrated preferred embodiment, the backstop member 60 is formed of one piece, the body 60 thereof having two opposite longitudinal walls 62 each shaped like a half circle arc opposite one another and interconnected at the end of the backstop member 60 which is away from the valve plate 30 by an end portion 67 provided with an inner central through hole 69 provided with a helical thread (see FIG. 5).

The backstop member 60 works as a backstop and lateral guide for the spring 70. The backstop function is accomplished by the base 61 of member 60 and the guide is the concave inner face arcs on the opposite walls 62, respectively. It also acts simultaneously as a backstop limiting a maximum axial displacement of the sealing disc 50 while the valve seat 33 is open, since the sealing disc 50 has a diameter larger than the inner longitudinal housing diameter **60*a* of the backstop member 60. Disc 50 hits against the adjacent end face of the backstop after pressing the spring 70 into the longitudinal housing 60*a***.

In the preferred construction, the fixed end 71 of the spring 70 is threaded in a helical thread of the hole 69 of the end interconnecting portion 67 of the backstop member 60. Accordingly, the spring 70 is axially and adjustably retained in the backstop member 60 at a position wherein the movable opposite end thereof 72 is freely supported in a tight way on the outer face of the sealing disc 50. This is accomplished without exerting any pre-tensioning upon the sealing disc when the same is in a seated position against the valve seat 33. The system for attaching the spring 70 to the backstop member 60 allows for regulation of the positioning in terms of axial clearance of the spring 70 in relation to the valve seat 33.

Figure 2:
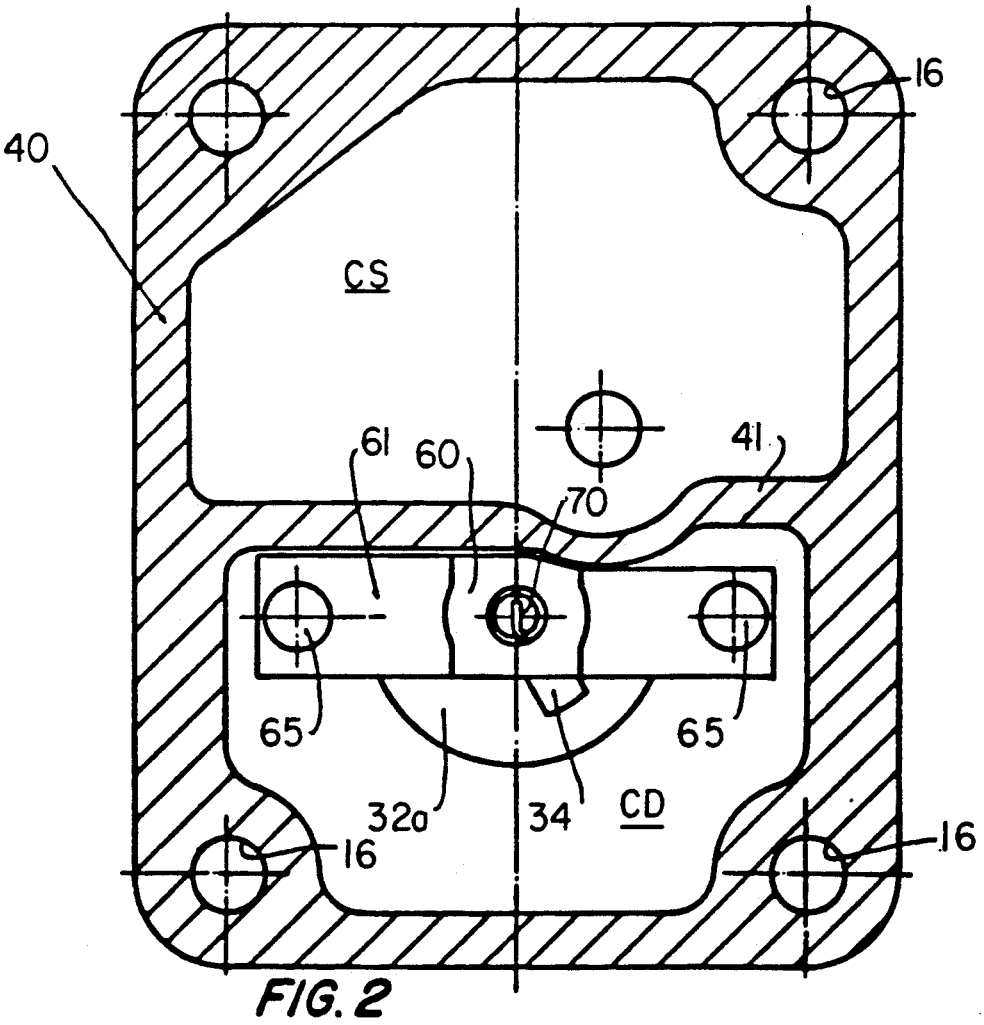
FIG. 2 is a cross section view of the present assembly along line II—II of FIG. 1.

As can be seen in FIG. 2, the width of the opposite longitudinal walls 62 and the radial flanges 61 of the backstop member 60 is sized in conjunction with the larger diameter of the side sloped wall 32*a* of the recess 32 in the valve plate 30. This will produce between the adjacent face of the backstop member 60 and the outer face of the valve plate 30, in the recess 32 area, a large passage which is nearly semi-annular being sloped for the refrigerating gas to flow out from inside the cylinder 10 into the discharge chamber CD.

The diverging tapered formation of the side wall portion of the recess 32 facilitates the gas flowing through the valve plate 30. It will be seen that the radial projections 34 do not cause any significant drawback for the gas freely to flow out.

FIG. 5 shows the thickness B of the sealing disc 50 and A as the distance between the top of the sealing disc and the bottom face of the backstop 60 against which the disc can hit, the latter also being seen in FIG. 1. The axial adjustment of the spring 70 sets the force which is required to unseat the disc from the vale seat.

Although only one embodiment of this invention has been herein described and illustrated, it should be understood that modifications could be made without departing from the inventive concept as defined in the claims.

We claim:

1. A discharge valve for a reciprocating hermetic compressor comprising:

a cylinder housing a reciprocally driven piston; a valve plate mounted on the cylinder and having a discharge orifice, the outer face of the valve plate having a recess with a side wall surrounding said discharge orifice and defining a valve seat;

a sealing member axially movable between a closing position against the valve seat and an opening position away from the valve seat;

a backstop member attached to the valve plate and extending above the sealing member to limit the opening axial displacement of the sealing member, said backstop member including adjustable mounting means for a resiliently deformable means;

resiliently deformable means having one end adjustably attached to said backstop member mounting means to place its other end, opposite to the first one, at a selected location adjacent to the outer face of the sealing member, opposite to the face seating against the valve seat, when the later is at a closing position of the valve seat, said resiliently deformable means being pressed by the sealing member, from a non-pressed condition to a resiliently pressed condition, when the sealing member is displaced from the closing to the opening position by a predetermined pressure value in the cylinder.

2. A discharge valve according to claim 1, wherein the backstop member mounting means comprises an internally threaded hole on the backstop member and the fixed end of the resiliently deformable member is threaded into the internally threaded hole.

3. A discharge vale according to claim 2, wherein the resiliently deformable member comprises an elongated helical spring with its center axis coinciding with the center of the sealing member.

4. A discharge valve, according to claim 3, wherein the fixed end of the helical spring has its turns fitted into the thread of said hole.

5. A discharge valve according to claim 3, wherein the backstop member comprises an oblong body including a longitudinal housing, a portion of said deformable resilient member being elongated and located within said housing, the body being open at a first end adjacent to the valve plate, said first end being attached to the outer face of the valve plate.

6. A discharge valve according to claim 5, wherein said first end of the oblong body of the backstop member defines the limiting backstop for the opening axial displacement of the sealing member.

7. A discharge valve according to claim 5, wherein the first end of the oblong body incorporates radial flanges fitted in and attached to recesses located in the outer face of the valve plate.

8. A discharge valve according to claim 5, wherein the backstop member housing includes two internal spaced longitudinal opposing walls of arcuate shape to guide the elongated deformable member.

9. A discharge valve according to claim 1, wherein the valve seat is an annular projection extending from the bottom of the recess and is set back in relation to the plane of the outer face of the valve plate, the valve seat being spaced from the side wall of the recess.

10. A discharge valve according to claim 9 wherein the recess side wall has a diverging tapered surface portion.

11. A discharge valve according to claim 9 further comprising projections extending from the side wall, the upper ends of projections axially extending upwardly to below the outer face of the valve seat.

12. A discharge valve, according to claim 11, wherein the interior faces of the projections define arc portions of a circumference having a diameter slightly larger than the sealing member contour.

13. A discharge valve, according to claim 1, wherein the sealing member is shaped like a disc.

* * * * *